United States Patent [19]

Kaltenthaler et al.

[11] Patent Number: 4,685,653

[45] Date of Patent: Aug. 11, 1987

[54] VALVE ASSEMBLY

[75] Inventors: Wolfgang Kaltenthaler, Wennigsen; Manfred Kramer, Barsinghausen; Heinz-Dieter Gelse, Wunstorf, all of Fed. Rep. of Germany

[73] Assignee: WABCO Westinghouse Fahrzeugbremsen GmbH, Hanover, Fed. Rep. of Germany

[21] Appl. No.: 801,888

[22] Filed: Nov. 26, 1985

[30] Foreign Application Priority Data

Dec. 18, 1984 [DE] Fed. Rep. of Germany ..... 3446096

[51] Int. Cl.[4] ..... F16K 31/122

[52] U.S. Cl. ..... 251/63.6; 251/64; 251/284; 417/307

[58] Field of Search ..... 251/62, 64, 63, 63.4, 251/63.5, , 63.6, 284; 123/188 AA, 90.14; 417/296, 297, 307; 92/85 R; 137/509, 494

[56] References Cited

U.S. PATENT DOCUMENTS

| | | | |
|---|---|---|---|
| 896,439 | 8/1908 | Criner | 123/90.14 |
| 1,427,111 | 8/1922 | Knudsen | 123/90.49 |
| 2,172,751 | 5/1938 | Heinrich | 417/307 X |
| 3,041,715 | 7/1962 | Norton | 251/337 |
| 3,185,142 | 5/1965 | Peras | 251/337 |
| 3,512,454 | 5/1970 | Perkins | 91/461 |
| 4,505,648 | 3/1985 | Heger et al. | 417/297 |
| 4,522,568 | 6/1985 | Gelse et al. | 417/307 |
| 4,553,907 | 11/1985 | Heger et al. | 417/297 |

*Primary Examiner*—Robert G. Nilson
*Attorney, Agent, or Firm*—J. B. Sotak

[57] ABSTRACT

A valve assembly having a valve seat, and a valve tappet that moves relative to the valve seat. A stop member for limiting the stroke of the valve tappet. The valve tappet includes an elongated shaft having a reduced mid-section for the purpose of increasing flexibility. The stop member for the valve tappet is a flexible ring-shaped element which functions like a spring washer. As a result of the shape of the valve tappet and of the stop member, any sudden excessive forces or stresses occurring during the opening and closing of the valve are partially suppressed by the elastic characteristics to avoid damage to the valve assembly. The energy-absorbing features avoid breakage of the shaft and eliminate deformation of the valve piston and the stop member in the area of the stop communicating surfaces, and also reduce damage to the sealing surfaces between the tappet head and the valve seat. Accordingly, the useful life of the valve is materially increased, so that cost savings of repair or replacement is realized.

10 Claims, 1 Drawing Figure

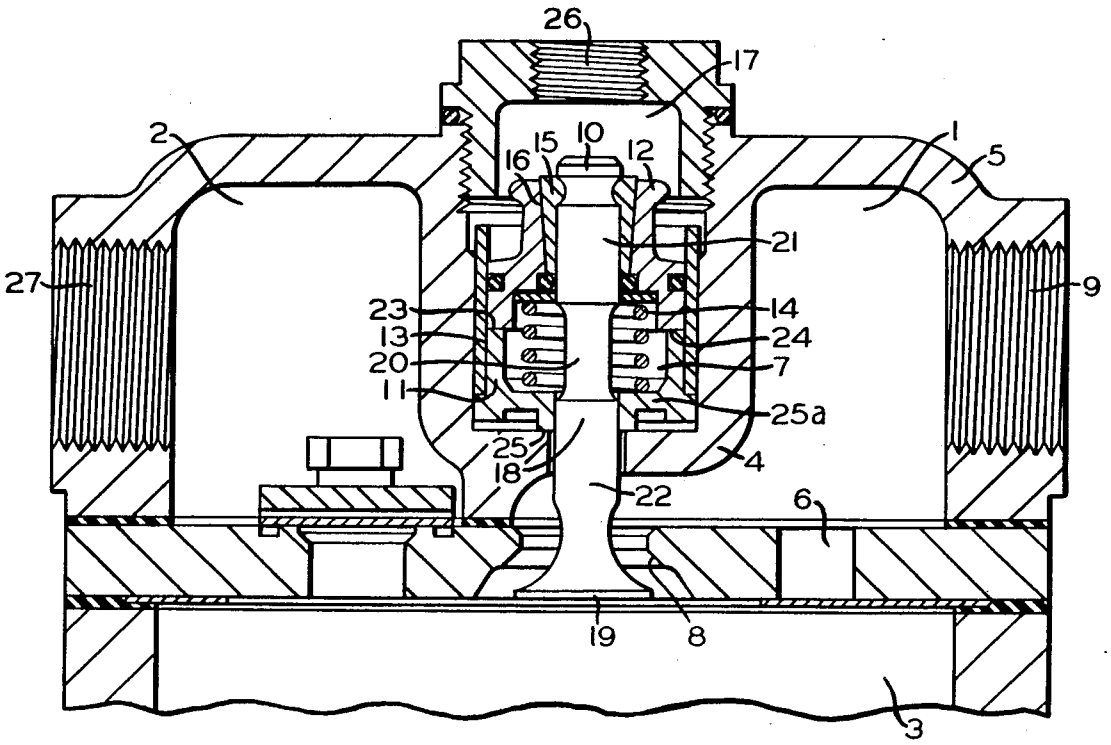
9
5
1
17
26
21
12
10
15
16
14
24
7
25a
4
6
22
8
19
3
25
18
23
13
20
11
2
27

VALVE ASSEMBLY

FIELD OF THE INVENTION

This invention relates to a unique valve assembly and, more particularly, to an improved valve arrangement wherein damage to be elongated stem and head of a tappet valve and its valve seat is reduced and minimized by the flexibility of the elongated stem and the elasticity of a stop member to absorb excess deforming forces.

BACKGROUND OF THE INVENTION

A previous valve assembly is shown and described in the text entitled "Handbook of Motor Vehicle Technology", by Buschmann/Koessler, Volume 1, pages 199 and 200 as follows:

2.2.1.4. Valve Movement 2.2.1.4.1. Designs

FIG. 4 illustrates by means of an example the basic principle of valve movement. In the cone seat, the valve has to seal well due to spring pressure and gas pressure, and has to transfer heat to the coolant (with air cooling, to the cylinder ribbing) by way of seat contact during the time of closure, so that the heat is not limited to being eliminated only by way of the valve stem through the cooled stem guide. This, incidentally, requires a sufficiently large stem cross section to function as heat conductor. Because of an excessive resistance to heat condition, a stem cross section which is of only slightly less than sufficient size can cause the valve disk to burn due to the accumulation of heat, because the heat elimination through the valve seat, being interrupted by the valve lift, is not sufficiently supported by the stem. Exhaust valves can experience temperatures of up to 650° . . . 800° C., depending on mixture, load, or rpm. Inlet valves can reach about half this value. FIG. 9 gives an indication of the temperature distribution in an exhaust valve on the basis of measurements carried out on an internal combustion engine. A certain amount of tappet clearance must exhist between the stem and and the tappet so that the valve cone can be sure to make contact in its cone-shaped seat (→ FIG. 10).

FIG. 10 shows the mechanism of a side-by-side disk valve driven by cams and mushroom or roller tappets, while FIG. 11 shows a few other possibilities for inverted or over head valves.

The term of overhead valve engine refers to a design in which valve disks and gas ports for inlet and exhaust are located above the conical surface plane at the top dead center. With the overhead valve, the driving cam shaft may also be located below the plane mentioned. This is true for all the examples in FIG. 11. With side-by-side valve engines, valve disks and gas ports are located below the plane mentioned, and the valves are side-by-side valves (DIN 1940 [Deutsche Industrienorm—German Industrial Standard]).

In case of inaccuracies in the assembly which may occur especially with repair work or after heat elongation of the valve stem, the absence of a tappet clearance at the stem end could lead to the appearance of a gap between the conical surface at the valve seat and thus to not only the obstruction of heat elimination, but also to a flow of hot gases through the gap and, therefore, the burning of the free valve cone edges within a short period of time. In most cases, a jet flame then burns a hole into the valve disk at a particularly endangered spot, and the pressure at compression and ignition which has already decreased due to leakage diminishes the engine performance increasingly. Since the occurrence of severe wear has to be expected at the valve seat surfaces, which are abruptly subjected to very high stress, and also at the time end, the tappet clearance must be adjustable in a manner similar to the one shown in FIG. 10 or 11e; otherwise, a design could be used which automatically maintains a constant tappet clearance (see below).

The tappet clearance amounts to only a few tenths of a millimeter and its dimensions should be determined by experiment at values large enough that it could not be obliterated due to the heat extension of the affected parts, and small enough that the stroke does not cause too much noise during operation at the moment of starting valve lift, i.e., after the slide stroke or the lever movement has surmounted the clearance in the way shown in FIG. 11. The tappet clearance is to be indicated in the operating instructions for the cold machine, after it has been determined as sufficient with a machine which has been heated through operation. In most cases, a special spring action is to be provided so that the contact between cam and the parts moved directly by the cam is not interrupted while the valve remains closed. Such an apparatus is commonly used with an internal combustion engine, which is provided with a compressor that is capable of being switched from the operating phase to the idle phase when a predetermined pressure is exceeded in a compressed air consumer load that is connected with the compressor. The switching action from the operating phase to the idle phase is accomplished in such a way that an actuating device is controlled by the predetermined pressure appearing in the compressed air consumer load. As shown, the excessive pressure moves the valve tappet of the valve assembly into a position in which the compression chamber of the compressor is connected with the suction chamber. In this open position of the valve assembly, the compressor operates in an unloaded condition in the idle phase. When the consumer pressure falls below the predetermined pressure, the actuating device allows the valve tappet to move back to its initial position in which the existing connection between the compression chamber and the suction chamber is interrupted by the valve assembly, and the compressor reverts to its operating phase.

Internal combustion engines use a valve assembly which takes the form of cam controlled tappet valves which are spring-biased in the opening direction, but not against an adequate stop. The described application of such an apparatus in a compressor application requires that an adequate stop be provided for the valve tappet in the opening direction of the valve seat, so that the head of the valve tappet cannot be pushed or driven too far into the compression chamber. The excess projection of a tappet head too far into the compression chamber would necessitate an enlargement of the compression chamber, since the compressor pistons could strike the tappet head in the upper top dead center, which could thereby impair the operation of the compressor.

However, the use of an extremely rigid and strongly biased stop for the valve tappet presents the problem that when the valve is opened and closed, the valve tappet must overcome a strong control force when activated suddenly, and the valve tappet is stopped just as abruptly by rigid stroke limit. This can lead to a breakage of the valve tappet and also to a damage to the stop due to overstraining of the material.

In order to overcome or counteract these problems, it would seem obvious to reduce the biasing forces which effect the valve and/or to allow the effect of the forces to gradually increase or decrease. However, this causes the valve tappet to become unstable when in the open and close positions, and results in the so-called knocking or bouncing which is not highly desirable in the compression operation of the compressor pistons. It is known that such knocks or tapping of the valve tappets is comparable to being hit with a hammer, and results in the damage to the valve seat and to the valve tappet head.

OBJECTS AND SUMMARY OF THE INVENTION

Therefore, it is an object of this invention to alleviate the above-noted problems by employing a simple means in comparison with previously known valve apparatus in such a way that when the valve assembly is opened and closed, the forces effecting the functioning parts of the valve assembly are so minimal, despite the abrupt strokes of the valve tappet, that damage to the functioning parts is minimized or their premature wear is noticeably diminished, even with continuous operation.

In accordance with the present invention, there is provided a valve assembly comprising:

(a) a valve seat, and a valve tappet that moves relative to the valve seat;

(b) a valve tappet including an elongated shaft and a tappet head, whereby the tappet head cooperates with the valve seat to form a valve;

(c) a flexible stop member for limiting the amount of movement of the valve tappet in the opening direction of the valve;

(d) the shaft of the valve tappet including a reduced cross-section portion for exhibiting elastic flexibility property; and (e) the reduced cross-section portion is located intermediate the ends of the shaft and is disposed in the vicinity of the stop member which has a stop surface spaced a given distance from the central axis of the valve tappet, a support surface spaced a different distance than the given distance from the central axis of the valve tappet, and a deflectable spring-like area located between the stop surface and the support surface, so that the excessive forces exerted on the valve tappet are absorbed by a flexible action to prevent damage to the tappet valve.

The invention has the advantage of increasing the operational reliability and the life expectancy of the valve assembly.

BRIEF DESCRIPTION OF THE DRAWING

The invention is explained in more detail by reference to a specific valve embodiment, which is illustrated in the single Figure of the drawing.

DETAILED DESCRIPTION OF THE INVENTION

It will be seen that there is shown a partial representation of a compressor having a valve seat in accordance with the invention. The compressor includes a suction chamber 1, a pressure chamber 2, and a compression chamber 3. In the cylinder head 5, there is a valve arrangement which is located next to an inlet valve 6 formed in the upper portion of the housing or casing 4. As shown in the single Figure, the upper valve assembly interconnects the compression chamber 3 with the suction chamber 1 by means of a valve seat 8 and, in turn, to atmosphere via a suction port 9.

The valve seat assembly 7 cooperates with a valve tappet 10, a stop flexible member 11, and an actuating mechanism for the valve tappet 10. In the present embodiment, the actuating mechanism includes a movable or reciprocable valve piston 12. The valve piston 12 is slidably disposed and sealed in a bushing or sleeve 13. The valve piston 12 is biased toward the closing direction of the valve seat assembly 7 by a helical spring 14. The valve piston 12 is connected with the valve tappet 10 by a well-known keyed-joint 15, placed in a conical central bored hole 16 of the valve piston 12.

It will be seen that a control pressure chamber 17 is located above the valve piston 12. The chamber 17 is connected to a suitable source of compressed air by means of a control port 26. The source of compressed air is also connected, on the pressure side of the compressor, by means of a pressure port 27.

The valve tappet 10 includes an elongated shaft 18 and a tappet head portion 19 formed on one end thereof. The elongated shaft 18 is divided into three zones or sections 20, 21, and 22, with two different circular cross-sections. As shown, the middle section 20 of the shaft 18 has a smaller cross-section than the two adjoining areas 21 and 22 on either side thereof. The middle zone 20 extends approximately $\frac{1}{3}$ of the entire length of the shaft 18. The transition portion from the middle portion 20 to the upper and the lower shaft portions 21 and 22, adjoining the middle reduced portion or area on either side, are filleted. The valve piston 12 has at least one stop surface 23 arranged around the central axis of the valve tappet 10. The stop surface 23 faces and is supported by a stop surface 24 of the stop member 11.

As shown in the drawing, the stop member 11 is a metal annular or ring-shaped element which is arranged coaxially to the central axis of the valve tappet.

It will be observed that on the side facing the valve piston 12, the stop member 11 has at least one stop surface 24 arranged around the central axis of the stop member 11. On the side facing away from the valve piston 12, there is at least one support surface 25 arranged around the central axis of the stop member 11. The stop surfaces 23 and 24, as well as the support surface 25, can consist of a closed ring surface or of a ring surface formed by separate faces. The distance of the stop surface 24 from the central axis of the stop member 11 is different from the distance of the support surface 25 from the central axis of the stop member 11, whereby the stop member 11 is formed elastically and bends like a spring washer. The stop member 11 supports itself with its support surface 25 against the portion of the casing 4 of the cylinder head 5. The stop face 24 of the stop member 11 establishes the movement or stroke of the valve tappet.

The description of the operation of the valve of the present invention is as follows:

Now, when the pressure in the compressed air assembly, connected to the compressor, reaches a predetermined value, a control pressure is introduced and conveyed to the control port 26 of the control pressure chamber 17 of the valve seat assembly 7. The elevated control pressure moves the valve piston 12, along with the valve tappet 10, against the force of the spring 14, toward the opening position of the valve seat assembly 7. This stroke of the valve tappet 10 is limited by the stop surface 23 of the valve piston 12, which strikes the stop surface 24 of the stop member 11. This places an undue stress or load on the valve tappet 10 and on the stop member 11. Due to the momentum of the impulses on the tappet head 19, the load on the valve tappet 10 nears its tensile stress or breaking point, which is partially compensated for by the reduced cross-section in the middle area or portion 20 of the shaft 18, and by a resulting in the bending in the elasticity or flexibility portion of the shaft 18 to counteract any possible fracture or breaking of the valve tappet 10.

Another pressure, which corresponds to a pressure effecting the stop member 11, is introduced to the stop member 11 by means of the stop surface 23 of the valve tappet 10 over the stop surface of the stop member 11. This pressure is partially converted into flexural load or bending by means of the different distances of the stop surface 24 and the support surface 25 to the central axis of the stop member 11. The flexural load of the deflection energy absorption area 25*a* which is undercut as shown in the drawing, located between the stop surface 24 and the support surface 25 of the stop member 11, acts like a spring washer. A remaining portion of the pressure supports itself by means of the support surface 25 of the stop member 11 on the portion of the casing 4 of the cylinder head 5.

The partial conversion of the excess pressure force into a flexural load, which results from the described shaping of the stop member 11, also has a subduing effect on the tensile stress that affects the valve tappet 10.

When the pressure within the compressed air assembly falls below the predetermined value, the control pressure chamber 17 is connected with the atmosphere by means of the control port 26. In doing so, the spring 14, which was contracted during the compression operation of the compressor piston, abruptly moves the valve tappet 10 along with the valve piston 12 into the upper position, where the valve seat assembly 7 assumes its initial position. This upward stroke of the valve tappet 10 is limited by the tappet head 19 of the valve tappet 10 by engaging the valve seat 8. As a result of the abrupt and immediate stopping of the valve tappet 10 and the valve piston 12, a tension stress and deflection occurs in the middle flexible portron 20 of the shaft 18. As was previously described, this tension stress or exertion is partially compensated or counterbalanced by the unique energy absorbing shape of the shaft 18.

As a result of the shape of the valve tappet 10 and of the stop member 11, when the valve seat assembly 7 is opened and closed, any sudden occurring material stresses are partially counterbalanced or offset by the elasticity of the tappet and the stop member in such a way that the following defects are avoided: a rupture in the shaft 18, a deformation of the valve piston 12 and of the stop member 11 in the vicinity of the stop surfaces 23 and 24, and the destruction of the sealing surface on the tappet head 19 and on the valve seat 8.

Thus, the bendable reduction portion 20 and the defectable spring-like area 25*a* absorb excessive pressure forces that are imparted to the valve tappet during opening or closing of the valve 8, 19 to prevent damage to the valve shaft or stem 18.

The valve seat assembly 7 of the present invention is not limited to use in conjunction with a compressor, but can be used in other apparatus in which the forces affecting such a valve seat apparatus are the same or similar.

While compressed air was selected for the control of the valve seat assembly 7, in the presently described embodiment, the control force can also be hydraulic, electro-hydraulic, or electro-pneumatic, as well as by a mechanical means of activation.

Thus, the present invention has been described in such full, clear, concise and exact terms as to enable any person skilled in the art to which it pertains to make and use the same, and having set forth the best mode contemplated of carrying out this invention. We state that the subject matter, which we regard as being our invention, is particularly pointed out and distinctly claimed in what is claimed. It will be understood that variations, modifications, equivalents and substitutions for components of the above specifically described embodiment of the invention may be made by those skilled in the art without departing from the spirit and scope of the invention as set forth in the appended claims.

I claim:

1. A valve assembly comprising:

(a) a valve seat, and a valve tappet that moves relative to the valve seat;

(b) a valve tappet including an elongated shaft and a tappet head, whereby the tappet head cooperates with the valve seat to form a valve;

(c) a metal flexible stop member for limiting the amount of movement of the valve tappet in the opening direction of the valve;

(d) the shaft of the valve tappet including a reduced cross-section portion for exhibiting elastic flexibility property; and (e) the reduced cross-section portion is located intermediate the ends of the shaft and is disposed in the vicinity of the stop member which has an outer stop surface spaced a given distance from the central axis of the valve tappet, an inner support surface spaced a different distance than the given distance from the central axis of the valve tappet, and a deflectable undercut area located between the outer stop surface and the inner support surface, so that the excessive forces exerted on the valve tappet are absorbed by a flexible action to prevent damage to the valve tappet.

2. The valve assembly, according to claim 1, wherein:

(a) the reduced cross-section portion is located approximately in the middle portion of the elongated shaft; and (b) a reduced cross-section portion covers approximately $\frac{1}{3}$ of the length of the shaft.

3. The valve assembly, according to claim 1, wherein the transition portions between the reduced cross-section portion of the shaft and the end portions of the shaft are filleted.

4. The valve assembly, according to claim 1, wherein a pressure actuated device cooperates with the shaft for moving the valve tappet in an opening direction away from the valve seat.

5. The valve assembly, according to claim 4, wherein the pressure actuated device consists of a valve piston that is connected to the valve tappet.

6. The valve assembly, according to claim 5, wherein the valve piston is connected to the valve tappet by a keyed-joint connection.

7. The valve assembly, according to claim 6, wherein the valve piston includes a conical central bore hole, which is part of the keyed-joint connection.

8. The valve assembly, according to claim 1, wherein the stop member for limiting the movement of the valve tappet is a ring-shaped element, which is arranged coaxially to the central axis of the valve tappet.

9. The valve assembly, according to claim 8, wherein the stop member is an elastic element which functions like a spring washer.

10. The valve assembly, according to claim 1, wherein a compression spring is disposed in the vicinity of the stop member for biasing the valve tappet in a closing direction so that the tappet head is moved toward the valve seat which is located between a suction chamber and a compression chamber to control communication between the compression chamber and the suction chamber.

* * * * *